US006251054B1

(12) United States Patent
Cruz et al.

(10) Patent No.: US 6,251,054 B1
(45) Date of Patent: Jun. 26, 2001

(54) REGISTRATION OF PAPER IN A CURVED PAPER PATH

(75) Inventors: Israel Cruz; Marco A. Guerrero, both of Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/368,488

(22) Filed: Aug. 4, 1999

(51) Int. Cl.[7] ..... B31B 01/68

(52) U.S. Cl. ..... 493/383; 270/37; 270/52.14; 270/32

(58) Field of Search ..... 270/37, 32, 39.06, 270/38, 52.07, 52.14, 58.12; 493/383

(56) References Cited

U.S. PATENT DOCUMENTS 4,046,366 * 9/1977 McCain et al. .
4,281,920 * 8/1981 Cross .
4,410,170 * 10/1983 Wertheimer et al. .
4,592,651 * 6/1986 Oikawa et al. .
4,595,187 * 6/1986 Bober .
5,938,100 * 8/1999 Bloser et al. .
6,022,011 * 2/2000 Hirsoe .

* cited by examiner

*Primary Examiner*—Eugene Kim

(57) ABSTRACT

A post-processing mechanism for a printer or the like includes a curved paper path. Post-processing operations such as stapling or other binding are performed either within the curved paper path or during the withdrawal of a document from the curved paper path. The curved paper path permits such post-processing operations to be performed within a limited space, while reducing the complexity of the post-processing mechanism and reducing the complexity of operations performed by the post-processing mechanism.

15 Claims, 2 Drawing Sheets

REGISTRATION OF PAPER IN A CURVED PAPER PATH

FIELD OF THE INVENTION

The present invention relates to paper handling. More specifically, the invention relates to folding and manipulation of documents for folding.

BACKGROUND OF THE INVENTION

Printing of documents is often followed by post-processing paper handling. In a simple form, this includes collating or stapling. Often the document is such that post-processing includes stapling and folding, with registration and paper trimming requirements. Such post-processing requires additional equipment and increases the "footprint" or floor space required for such a machine.

Post-processing usually follows the printing process in which printing material is applied to paper or other sheet media. By "printing material" it is intended to describe laser toner, printing ink, or any other type of toner or material which is used for providing an image which is produced on the document. These are various types of imaging materials. It is, of course, possible that a variation in the material be established in suitable circumstances so that the pigmentation of the printing material is less noticeable. Such printing material is deposited upon "sheet media" which may include paper or other materials which are used for receiving a printed image. Typically, printed documents include at least sheet media and printing material.

"Document" is intended to describe one or more sheets which may be in the form of a booklet. A "print job" may include multiple copies of a document. A document can take a number of forms, but is often an assembly of sheets of paper or other sheet media. In this invention, the documents are generally bound by a row of staples. Typically, this is a "booklet," sometimes called "saddle stitch and fold." A booklet has more than one page, usually two to five or more pages. It has one or more staples that hold the pages together. The staples are located along a line, approximately at the middle of the page. Unless portions of the booklet are intentionally offset, and after the pages are stapled, the pages are folded along a staple line, meaning a line defined by the staples.

The term "MOPy" stands for multiple original prints. A "MOPy" is a reproduction of an original that is bounded within a single job that a user sends to print. The original can be in either physical or electronic form, and the print job can be composed of "n" MOPies. Each MOPy may have "x" number of sheets. Both n and x may be one or more MOPies and sheets, respectively. By way of example, a particular print job may include 5 MOPies "n" MOPies). Each MOPy may be comprised of 28 sheets "x" sheets). The print job would therefore comprise 140 sheets. By printing multiple MOPies, documents can be created, controlled, managed and finished from the user's desktop, eliminating the extra step of going to a photocopier.

The attachment of multiple larger sheets to form booklets is well-known, and the bookbinding art even has conventional number of pages in which smaller sections, called "signatures" or "units," containing 16, 32, or 64 pages, are assembled for purposes of printing and bookbinding. The present invention relates to a technique useful for creating signatures as well as for smaller signatures, pamphlets, as well as other folded or bound documents.

One commonly used method of permanently fixing multiple pages is stapling of the pages. When print jobs are produced by laser printing, photocopying and other short-run processes, it may be desired to fold or otherwise manipulate assembled documents. In the prior art, this was either done by hand, or by the use of paper handling equipment, such as sheet folders.

One of the aspects of sheet folders is that it was necessary to separately align, staple and then fold individual documents. This increased the expense of paper folding equipment. Additionally, the complexity of the equipment decreased reliability and increased the space required for a printer.

In the case of documents which are produced by the use of laser printers or photocopiers, any additional procedures involved in producing a final product, such as folding equipment,require the use of additional equipment. This additional equipment would be either within the printer or external to the printer, but in either case requiring additional expense and bulk. That means that the ability of providing office printers which are capable of providing assembled booklets or ether multi-page brochures is limited. It would be desired to provide a printer arrangement which allows assembly of multiple sheets of paper or other sheet media, but does not require a substantial investment in additional equipment for folding and other paper handling purposes. It is desired that the additional features be provided without making the printer or copier substantially more complicated or less economical to operate. It is therefore desired to provide a simplified automatic paper folder for such equipment.

In addition, the paper folding mechanism must, prior to folding the documents, transport the documents to an appropriate location for folding. This means that, often after the documents are assembled or otherwise sorted at a discharge end of a printer, these documents must again be handled. This can result in mishandling of the documents and of course results in increased complexity of the equipment.

Providing the ability to perform multiple post-processing operations generally increases the space or "footprint" occupied by a printer. This means that features which may otherwise be cost-effective may be undesirable because there is a space limitation. For example, if the post-processing operations include collation, alignment, center stapling, and folding, it is often necessary to provide a first space at which a stack of sheets can be accumulated, placed in registration and stapled. Additional space is needed for subsequent operations such as folding of the stapled document. In the case of booklets, often the booklet is formed from ledger sized paper (432×280 mm) or A3 paper, with the printer generally discharging the paper length wise. That means that the first receiver tray would be extending over 430 mm beyond the footprint of the printer. In addition, if, subsequent to the stapling, the document must be transferred to a folding mechanism, additional space may be required.

Often such printers are used for multiple purposes. Therefore, even though the printer with the stapling capability may be purchased with that capability in mind, it is often the case that the printer must perform tasks which do not require the extra equipment. In such a case, the printer may prove to be excessively large and inconvenient for everyday use.

It would therefore be desired to provide a printer in which such divers functions can be performed, but with less complexity of the equipment. It is further desired that post-processing operations be performed within a footprint which may be required for one post-processing process. It is further desired that the space required for any of the post-processing steps be small, particularly on equipment designed to handle larger sheets such as ledger, A3 or B3 paper.

Typically, the process to make a booklet is to add a set of staples, usually in the middle of the sheet. Once the document is stapled, it is folded at the center line so that it has a book appearance. The fold is accomplished with the aid of nip rollers in combination either with a feeding blade or with a pusher bar which buckles the document.

After such a booklet is folded, the cover page ends up being shorter than the center fold page if all of the sheets are printed on the same sized paper. In some cases, this is tolerated and the free edges of the pages form a tapering profile. In other cases, the tapered edge is cut so as to form a uniform profile. If a booklet is formed from multiple identical sheets folded at the center, this uniform profile can be accomplished by two techniques:

1. the booklet can be formed with the tapering profile and the free ends cut back.
2. the document can be folded so that one side of each of the sheet falls into registration, thereby doubling the misregistration of the other side. The other side may either be cut back or allowed to retain its taper.

In any case, the degree of taper is dependant upon the nature and thickness of the sheets as well as the open length of the sheets. It can be seen that equipment used to form such booklets must have some way of accommodating such taper. Furthermore, if booklets or signatures are to be trimmed, it is often necessary to provide the paper handling equipment with an ability to adjust for desired taper characteristics.

During the booklet making process, we are primarily interested in the centerline of the document, where we have to locate the staples and fold the document. The remainder of the booklet merely occupies space.

SUMMARY OF THE INVENTION

In accordance with the present invention, post-processing equipment for a printer or other paper handling device is configured so as to contain the paper or other sheet media within a curved catchment. The curved catchment includes a radial finger which provides an end stop for the sheet media. The radial finger maintains the sheet media in registration and is adjusted so as to position the sheet media with paper handling mechanisms positioned along the curved catchment. The curved catchment exhibits a reduced profile "footprint" and further permits movement of the sheet media within that reduced footprint to different paper handling mechanisms. This provides the advantage of using common equipment for alignment purposes while performing multiple functions. This also provides the advantage of reducing the overall footprint of the paper handling equipment.

In accordance with one aspect of the invention, a curved catchment is provided at a discharge end of a printer or other sheet media handling apparatus. The curved catchment has positioned a radial finger which extends from a center axis of the catchment. The radial finger forms an end stop for the sheet media discharged into the catchment and adjusts a position at which the sheet media falls into registration. In order to accomplish multiple operations such as stapling and folding, the radial finger first stops at a position aligned with a first mechanism, such as a stapler. After stapling is performed, the radial finger moves so as to position the sheet media into alignment with a second mechanism. Therefore, if the second mechanism is a folding device, the folding device can be caused to fold the document along a staple line.

The curve effects a partial displacement of the sheet media to form tapered ends. Therefore, some degree of automatic adjustment is accomplished by which the sheet media forms an even taper despite variations in the nature of the paper. This means that a requisite adjustment for achieving a desired taper is less than would be required for achieving such a taper property if alignment of the sheets were accomplished on a flat surface.

In one embodiment, a stapler mechanism is positioned along the curved catchment so that the sheet media may be stapled at a desired location such as along a center fold line. A folding mechanism is also located along the curved catchment. The radial finger can first be positioned so as to align a document with a stapling mechanism, and then repositioned so as align the document with a paper folding apparatus, even though the paper folding apparatus is offset with respect to the stapler.

In accordance with a further aspect of the invention, a paper handling device uses a novel curved paper path. The paper path reduces significantly the overall size of a booklet maker device and simplifies the positioning mechanisms used in current booklet makers instead of the traditional flat paper path used in all current devices.

Benefits of this circular approach are that the user will have a significantly more compact booklet making device which is more economical and less complex. For the designer, most of the mechanisms are highly simplified by using rotational mechanisms: there is no need to transform rotational motion from any motor into linear motion.

A radial finger is used as the mechanical stop that is needed to register the pages longitudinally and it may be easily adjusted to the desired paper length using a stepper motor. There is no need of any mechanism to transform rotational into linear motion to make this paper size adjustment. Pages are fed one by one and registered against the radial finger using two or three sets of flexible fingers. This will align every page and will force them to follow the surface of an outer cylinder forming the outside of the paper path.

Transverse registration is needed and this could be done using the same flexible fingers, at a certain angle to register the pages against a "fixed" wall. This transverse registration could also be made using a set of joggers.

When the document is complete and perfectly registered, the stapling process takes place, using two fixed electrical staplers.

Once the job is stapled, the document transported from the stapling to the folding position. It is used the same radial finger that pushes the stapled document from the stapling position to the folding position beneath the nip of the folding rollers. In the typical case, the radial finger pushes the stapled document from the stapling position at the centerline of the document beneath the stapler heads to the folding position also at the centerline of the document. Finally, a feeding blade could eject the document through a slot directly into the folding rollers.

DETAILED DESCRIPTION OF THE PREFERRED EMBODIMENTS

Figure 1:
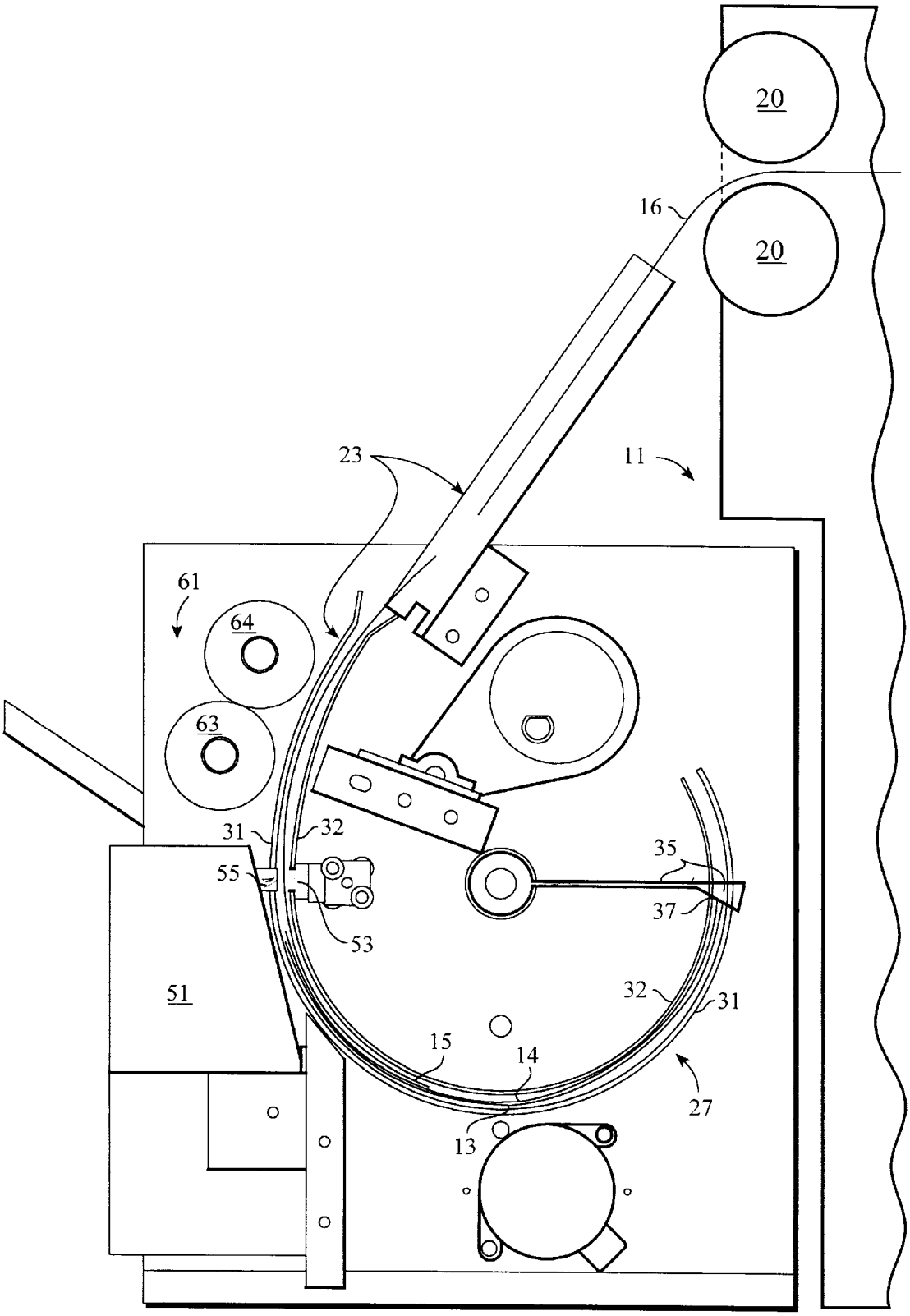
FIG. 1 shows a side view across the paper path of a printer which discharges its sheets along a circular paper path.

Referring to FIG. 1, a printer 11, such as a laser printer, discharges sheets of paper 13–16 one at a time. The discharged sheets 13–16 first pass through a discharge mechanism, represented by exit rollers 20. After passing the exit rollers 20, the sheets 1 3-16 enter a discharge path 23 which includes a catchment 27. 25 The catchment 27 includes outer and inner walls 31, 32 positioned so that the sequential sheets 13–16, when discharged from the printer 11 are slotted between the walls 31, 32. The catchment 27 is also positioned so that, after the sheets are discharged from the printer 11, the sheets 13–16 fall into catchment 27 to an end stop, established by a radial finger 35. In the example shown, sheets 13 and 14 have already fallen to engage a surface 37 forming an end plate of the radial finger 35. In this example sheets 15 and 16 have not reached that point. Sheet 15 is dropping toward the radial finger 35. Sheet 16 is being moved by the exit rollers 20. When that sheet 16 will have passed the exit rollers 20, that sheet will be positioned along the catchment 27 so that the sheet 16 will fall into the catchment 27 and follow sheet 15 to the radial finger 35. Thus, each of the sheets 13–16 will eventually come to rest against the radial finger 35, thereby falling into registration. Since the sheets 13–16 rest along a curved path formed by the walls 31, 32 there is a difference in the circumferential distance across which each individual sheet 13–16 extends. The innermost sheet 16 (not yet fallen into the catchment) will therefore extend along a greater number of degrees circumferentially around the catchment 27. Then the first sheet 13, which has a greater average radial distance from the center of the catchment 27. Thus, there will be a taper in the registration profile of the sheets 13–16. This taper is anticipated to correspond to a taper which will occur after the sheets 13–16 are folded.

In order to accomplish a stapling operation, a stapler 51 is provided. The stapler 51 includes an anvil 53 and a hammer 55. In this case the anvil 53 is on the inside of the catchment 27, so that the staples are discharged from the hammer 55 to the anvil 53 in a direction from the outside to the inside of the catchment 27. In order to properly position the staples at a desired location, the radial finger 35 is positioned so that the sheets 13–16 line up with the stapler 51. This can be accomplished by either positioning the radial finger 35 at a desired distance from the stapler 51, or by pivoting the radial finger 35 toward the stapler 51 until the sheets 13–16 are at a desired position. In the preferred embodiment, the radial finger 35 pivots. This allows the stapler 51 and other devices to be at a fixed position along the circumference.

Figure 2:
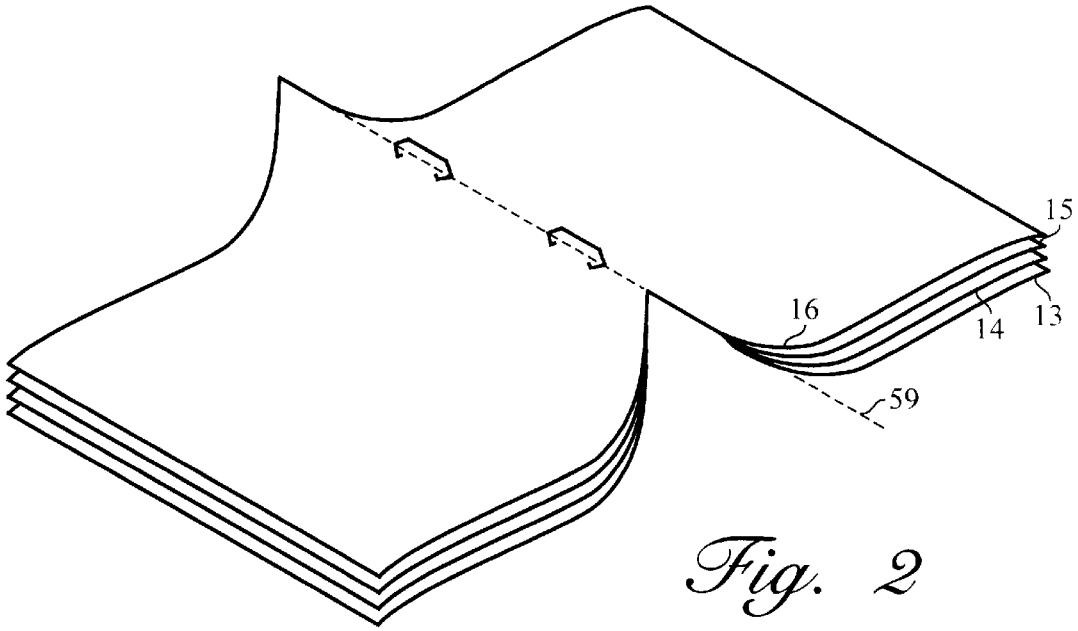
FIG. 2 shows a sample of a stapled, folded document.

Referring to FIG. 2, the sheets 13–16 are to be stapled and folded along a centerline 59 so that the radial finger 35 (FIG. 1) will position the sheets 13–16 so that the stapler 51 aligns with a staple line (centerline 59) half way along the length of the sheets 13–16. The stapler 51 achieves its stapling operation while the sheets 13–16 are within the catchment 27.

Figure 3:
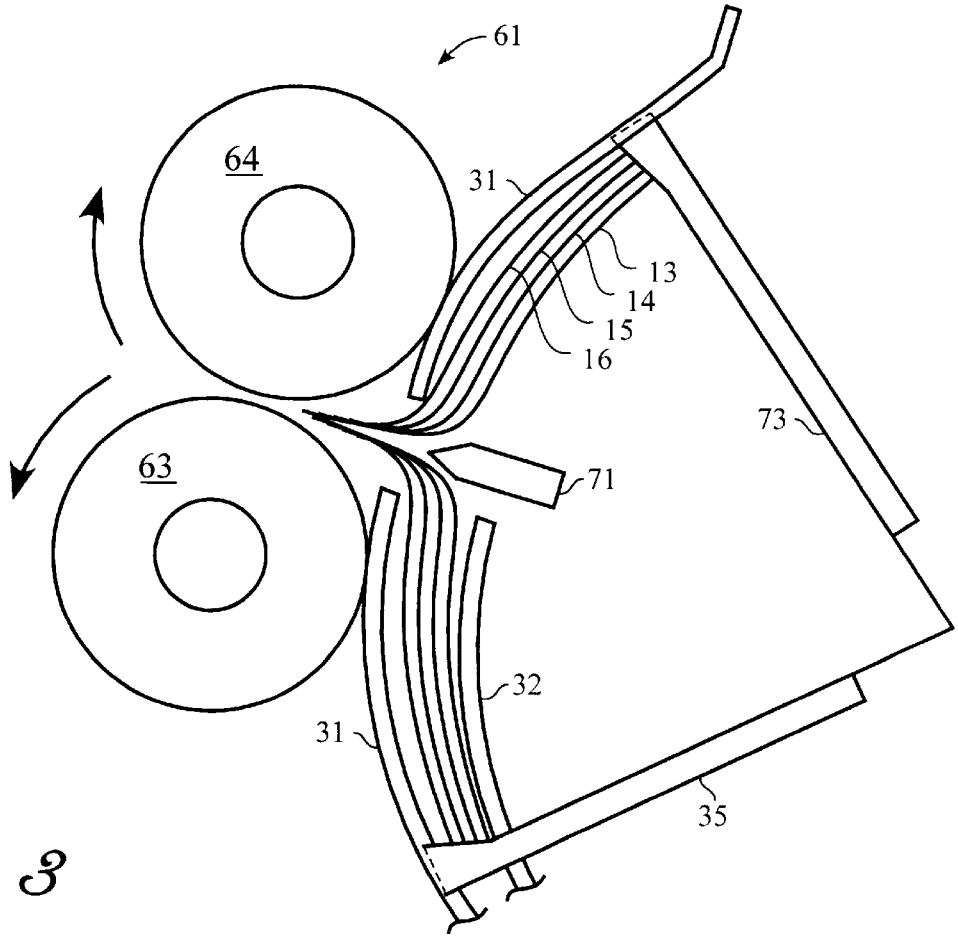
FIG. 3 shows details of a folding station of FIGS. 1 and 2.

Referring to FIG. 3, subsequent to stapling, the radial finger 35 moves the sheets 13–16 back toward a nip roller station 61. At the nip roller station 61, a pair of nip rollers 63, 64 are used to fold the stapled sheets 13–16. One of the nip rollers 63 includes magnets (not shown), so that when that nip roller 63 is positioned adjacent the centerline 59, the nip roller 63 attracts the document by attracting the staple. This magnetic attraction did not occur during the discharge cycle previously mentioned because, prior to the stapling operation, there was no staple in the sheets 13–16 to become attracted by the nip roller 63. It is also possible to avoid inadvertent magnetic attraction by rotating the nip rollers 63–64 so that the magnet is located a substantial distance away from the outer wall 31. It is also possible to provide some assistance to approach the stapled sheets 13–16 toward the nip rollers 63–64. This can be accomplished by use of a blade 71 or a second radial finger 73, or both. The blade 71 bends the sheets 13–16 up toward the nip rollers 63–64. The second radial finger 73 cooperates with radial finger 35 to buckle the pages by limiting the circumferential length between the radial fingers 35, 73. This buckling forces the pages to engage the nip rollers 63–64. When the pages 13–16 engage the nip rollers 63–64, the nip rollers 63–64 draw the pages up through the nip roller 63–64, thereby folding the stapled document.

As can be seen, it is possible to accomplish a number of different operations within the confines of a small space. It is also possible to vary the physical locations of the components such as the stapler 51 and the nip station 61. It is possible to shift the stapler 51 and nip station 61 so that a common, circumferential location is used to perform both the stapling and folding operations. It is also possible to achieve adjustments in the position of the staples along the length of the sheets 13–16. An example, if the radial finger 35 were moved close to the stapler 51, the sheets 13–16 would be stapled close to an edge of the sheets 13–16. While this is not normally the configuration for a folded document, this does permit the same mechanism to produce a stapled document of a different type.

The radial finger 35 can also be provided with a preferred profile. This is shown by end plate surface 37. The end plate surface is canted with respect to the radial direction of the finger 35, thus resulting in a predetermined taper for the sheets 13–16 after having been folded. This taper can be positive or negative within the catchment 27, depending upon whether it is desired to provide an even taper on the left and right sides of the finished booklet or it is desired to limit the requirement for cutting of the tapered ends of the stapled document after assembly.

Various modifications can be made by those of ordinary skill in the art with the benefit of this disclosure without departing from the spirit and scope of the invention. For example, it is possible to achieve adjustments in the positions of the stapling along the sheets 13–16 by moving the stapler 51. It is also possible to include a cutter or other post-processing device which is aligned by the catchment 27 and radial finger 35. Thus, the invention should not be limited by the specific embodiments used to illustrate it but only by the scope of the appended claims.

What is claimed is:

1. Paper handling equipment comprising:

a. a primary paper handling device capable of sequentially discharging single ones of a plurality of sheets, the plurality of sheets comprising a document;

b. a receiving catchment having a curved sheet media retaining space which includes two substantially concentric guides, wherein said individual sheets discharged from the primary paper handling device enter the catchment, said individual sheets caused to conform to a curve corresponding to the curved sheet media retaining space between the concentric guides; curve corresponding to the curved sheet media retaining space between the concentric guides;

c. an end stop establishing registration of the sheets in the stack within the curved sheet media retaining space; and d. a device for performing a further operation on the sheet media with the sheet media retained in the curved registration space.

2. The paper processing apparatus of claim 1 further comprising the catchment having a guide such that the individual sheets discharged from the primary paper handling device into the catchment enter the guide and subsequent sheets enter the guide and rest against previously discharged sheets in an order as a stack of sheets within the curved retaining space.

3. The paper processing apparatus of claim 2 further comprising an adjustable guide providing an adjustment transverse to a direction of movement of the sequentially discharged sheets into the curved sheet media retaining space.

4. The paper processing apparatus of claim 1 further comprising the end stop positionable so as to selectively align the stack with at least one station.

5. The paper processing apparatus of claim 1 further comprising said device for performing a further operation including a sheet material binding device positioned so as to bind the stack in the catchment while the end stop maintains registration of the sheets in the stack.

6. The paper processing apparatus of claim 1 further comprising:

a. a sheet material binding device positioned so as to bind the stack in the catchment while the end stop maintains registration of the sheets in the stack; and b. a folding mechanism capable of receiving the stack from the catchment in order to fold the stack, and further capable of folding the stack subsequent to binding of the stack.

7. The paper processing apparatus of claim 6 wherein the folding mechanism includes a pair of pinch rollers located substantially outside of a circumference of the curved sheet media retaining space, the folding effected by withdrawing the stack from the catchment between the pinch rollers.

8. The paper handling mechanism claim 6, comprising the folding mechanism positioned adjacent the catchment so as to receive the stack from the catchment at the beginning of at a fold line of the stack and withdrawing the stack from the catchment beginning at the fold line.

9. The paper processing apparatus of claim 6 wherein:

a. the folding mechanism retrieves the stack from a location along the catchment separate from the position of the sheet material binding device; and b. the end stop shifts in its position along the catchment in order to shift the stack where a fold line aligns with the binding device to a position where the fold line aligns with the folding mechanism.

10. Method of sheet media handling comprising:

a. discharging sheet media from a primary paper handling device by sequentially discharging single ones of a plurality of sheets, the plurality of sheets comprising a document;

b. receiving the sheet media in a catchment having a curved sheet media retaining space, wherein said individual sheets discharged from the primary paper handling device enter the catchment, and said curved media retaining space causes the individual sheets to conform to a curve corresponding to the curved sheet media retaining space between two substantially concentric guides;

c. establishing registration of the sheets in the stack with an end stop; and d. binding the sheet media within the curved registration space with the sheet media confined in the curved media retaining space and with the end stop establishing said registration of the sheets in the stack.

11. The method of claim 10 comprising adjusting the end stop to achieve a desired position of the sheets with at least one station within the catchment.

12. The method of claim 10 comprising:

a. selecting a position on the sheets for said binding of the sheet media; and b. adjusting the end stop to achieve a desired position of the sheets with respect to a binding mechanism so as to achieve said binding of the sheet media at said desired position.

13. The method of claim 10 comprising:

a. adjusting the end stop in its position along the catchment in order to shift the stack to a fold station, where a predetermined fold line on the sheets aligns with a folding mechanism; and b. using the folding mechanism to retrieve the stack from the catchment after said adjustment of the end stop.

14. Method of sheet media handling comprising:

a. discharging sheet media from a primary paper handling device by sequentially discharging single ones of a plurality of sheets, the plurality of sheets comprising a document;

b. receiving the sheet media in a catchment having a curved sheet media retaining space, wherein said individual sheets discharged from the primary paper handling device enter the catchment, and said curved media retaining space causes the individual sheets to conform to a curve corresponding to the curved sheet media retaining space between two substantially concentric guides;

c. establishing registration of the sheets in the stack with an end stop; and d. performing a further operation on the sheet media within the curved registration space, with the sheet media confined in the curved media retaining space and with the end stop establishing said registration of the sheets in the stack.

15. The method of claim 14 comprising adjusting the end stop to achieve a desired position of the sheets with at least one station within the catchment.

* * * * *